United States Patent [19]

Staniszewski et al.

[11] Patent Number: 5,050,274

[45] Date of Patent: Sep. 24, 1991

[54] FREE RUNNING AND CINCHING LATCH PLATE

[75] Inventors: Gary P. Staniszewski, Shelby Township, Macomb County; Surendra D. Narayan, Sterling Heights, both of Mich.

[73] Assignee: Allied-Signal Inc., Morris Township, Morris County, N.J.

[21] Appl. No.: 629,524

[22] Filed: Dec. 18, 1990

[51] Int. Cl.[5] ..... A44B 11/06

[52] U.S. Cl. ..... 24/171; 24/196

[58] Field of Search ..... 24/171, 194, 196; 280/801, 808; 297/483

[56] References Cited

U.S. PATENT DOCUMENTS 4,588,207 5/1986 Doty ..... 280/801

4,871,190 10/1989 Willey ..... 280/801

*Primary Examiner*—James R. Brittain

[57] ABSTRACT

A latch plate assembly (10) comprising: a plate (12) having a tongue (14) formed at one end (16) thereof, a back portion (18) opposite the tongue (14) and a first opening formed in the back portion (18); a web guide (40), is positioned about the back portion (18) which includes an elevated member (44) spaced above the back portion (18) and a lower member (42) positioned below the back portion (18). The members (42, 44) cooperate to define a web guide slot (46) which laterally extends relative to the plate (12) to receive the seat belt webbing (36). The elevated member (44), includes a sloped surface (48) extending away from the first opening (34) and a first engagement surface (50) extending laterally positioned across a rear side of first opening (34). The latch plate assembly further includes: a cover (70) slidingly received about plate (12) relative to the web guide (40). The cover comprising first and second side members (**72*a*, 72*b*), a top crossmember (74) and a bottom crossmember (76), each of the first and second side members (72*a*, 72*b*) including a slot (78*a*, 78*b*) through which is received a corresponding side (32*a*, 32*b*). The top crossmember (74) includes a rib (82) which extends into the first opening (34) so as to engage a front side of the first opening (34) when the cover (70) is slid forward on the plate (12) and to compressively load the seat belt webbing (36) against the first engagement surface (50) when the cover (70**) is moved rearwardly.

7 Claims, 2 Drawing Sheets

FREE RUNNING AND CINCHING LATCH PLATE

BACKGROUND AND SUMMARY OF THE INVENTION

The present invention relates generally to a tongue plate for a seat belt and more specifically to a tongue plate usable in a 3-point seat belt system.

Self-locking tongues or latch plates are commonly used to tighten and secure the shoulder and/lap portion of a seat belt around the occupant. These self-locking tongues or latch plates must be capable of sliding (free running) on the webbing in order to provide a proper fit over the occupant and must be able to lock i.e. cinch, during crash situations to prevent loosening of seat belt portion to properly protect the occupant.

Typical of prior art latch plates are the U.S. Pat. Nos. 3,408,707 and 4,871,190 which use a detachable cover and a slide bar. One problem with these latch plates is that if for whatever reason the cover is removed, the lock bar will fall out thereby disabling the operation of the latch plate.

It is an object of the present invention to provide a latch plate assembly which is both free running and cinching. A further object of the present invention is to provide a latch plate assembly which is lightweight. An additional object of the present invention is to provide a latch plate which is simple to assemble.

Many other objects and purposes of the invention will be clear from the following detailed description of the drawings.

According, the invention comprises: a latch plate assembly comprising: a plate having a tongue formed at one end thereof, and a back portion opposite the tongue. The tongue including means for receiving a locking mechanism of a cooperating buckle, such receiving means including at least one aperture formed in the tongue. The back portion includes a front cross bar and a rear cross bar and sides joining the front cross bar with the cross bar, forming an integral unit and further including a first opening of sufficient size to receive seat belt webbing (36). A web guide, fabricated of a synthetic material such as Nylon 6/6, is insert molded about the rear cross bar. The web guide includes an elevated or raised member and a base or lower member. The raised member is spaced from the base member and rear cross bar. The raised and lower members cooperate to define a web guide slot, positioned above a plane containing the rear cross bar and laterally extending to receive the seat belt webbing. The base member includes a sloped surface extending away from the first opening and a first engagement surface extending laterally across a rear side of first opening. The latch plate assembly additionally includes a cover typically fabricated of Nylon 6/6 slidingly received about plate. The cover comprises first and second side members, a top crossmember and a bottom crossmember. Each of the first and second side members includes a slot through which is received a corresponding side of the plate. The top crossmember joins the first and second side members and is slidably received relative a top surface of the front cross bar. The top crossmember also includes a rib which extends into the first opening so as to engage a front side thereof when the cover is slid forward on the plate and to compressively load the seat belt webbing against the first engagement surface when the cover is moved rearwardly. The top crossmember may optionally include reinforcement means for stiffening same.

Such reinforcement means includes a rigid preferably metal bar molded within the top crossmember. The bottom crossmember joins the first and second side members and is spaced from the underside of the plate and the bottom of the rib such that the webbing may extend through the first opening and extend through the underside space forward of the bottom crossmember to exert a reaward pressure thereon.

DETAILED DESCRIPTION OF THE DRAWINGS

Figure 1:
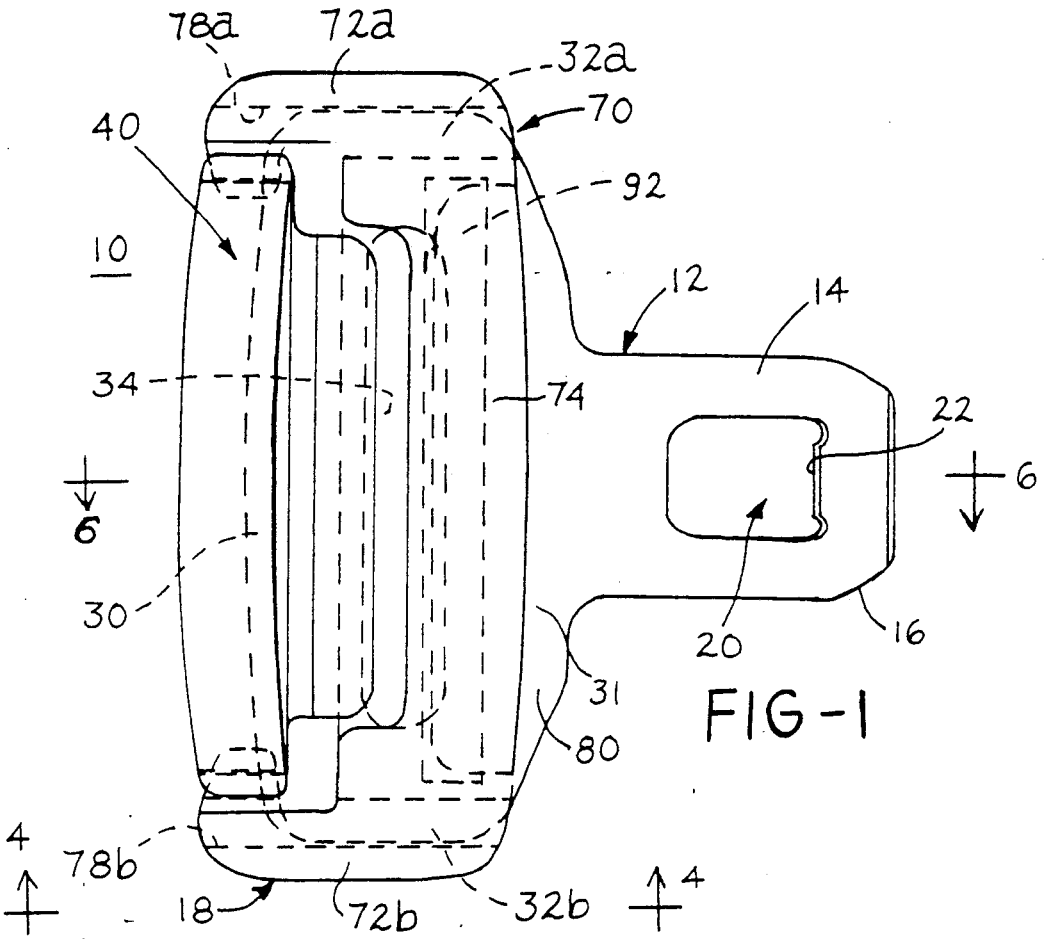
FIG. 1 illustrates a top plan view of a latch plate assembly according to the present invention.

With reference to the FIGURES there is shown a latch plate assembly 10. The major components of the latch plate assembly 10 are a latch plate 12, a web guide 40 mounted to the plate, and a sliding cover 70. The plate 12 comprising a tongue 14 formed at one end 16 thereof. The plate also includes a back portion 18 oppositely positioned relative to the tongue. The tongue 14 includes a means for receiving a complementary latching mechanism of a buckle (not shown). Such receiving means 20 may include at least one aperture 22 of known variety formed in the tongue 14. The back portion 18 includes a rear cross bar 30 and a front cross bar 31. These cross bars 30 and 31 are joined by side portions 32*a* and *b*. A first, generally oblong opening 34 is formed in the plate and is of a sufficient size to receive the relatively narrow, flat seat belt webbing 36 (which is shown in FIG. 6).

Figure 2:
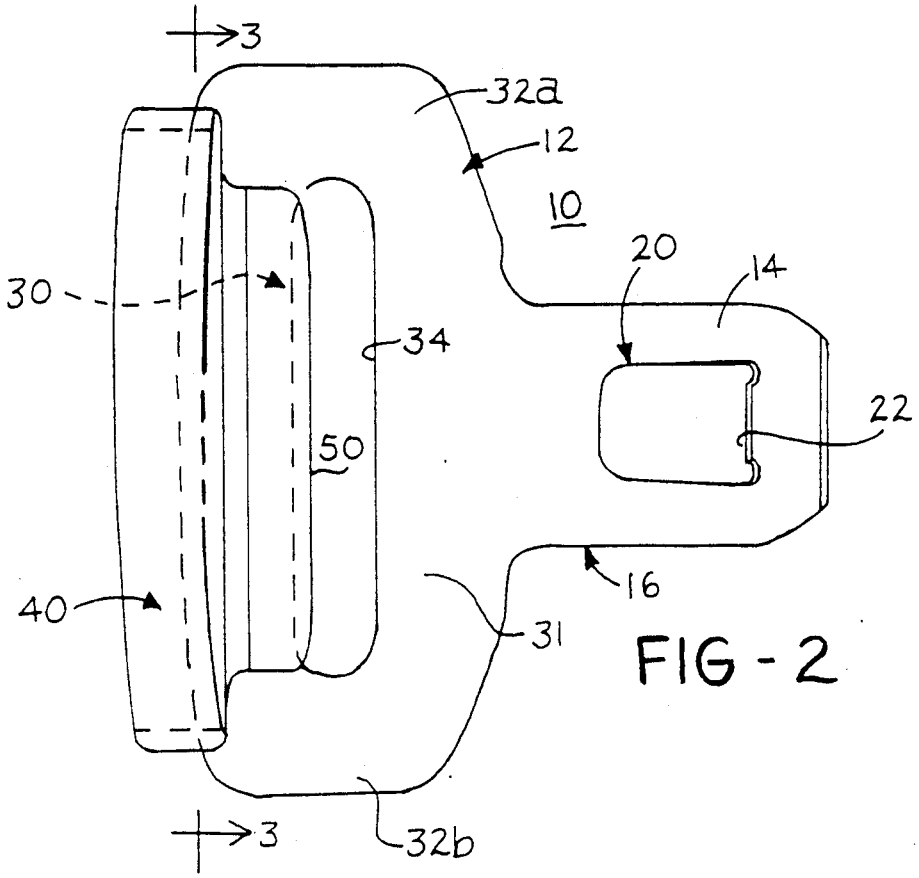
FIG. 2 illustrates the latch plate shown in FIG. 1.
Figure 4:
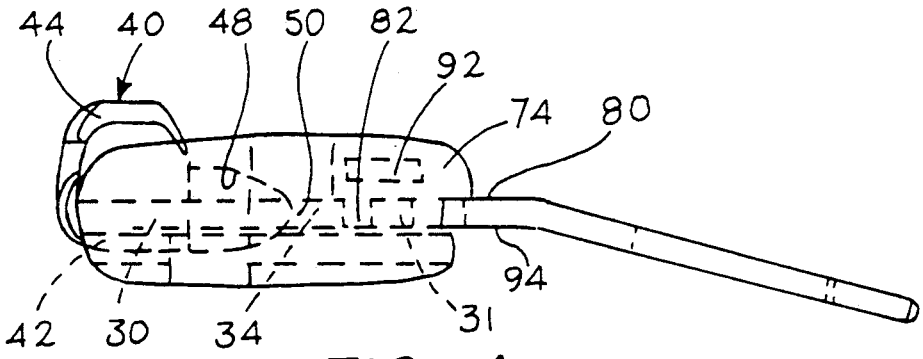
FIG. 4 illustrates a side plan view of the tongue shown in FIG. 1.
Figure 5:
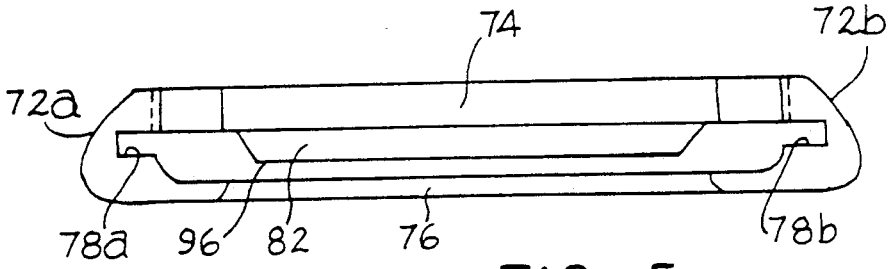
FIG. 5 shows an isolated end view of a cover shown in FIG. 1.
Figure 3:
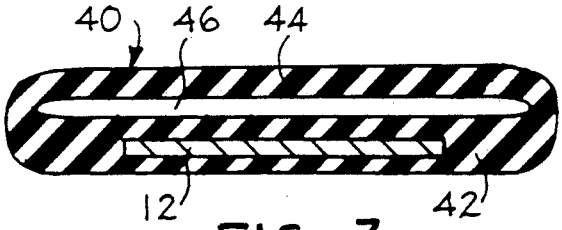
FIG. 3 illustrates a cross-sectional view taken through section lines 3—3 of FIG. 2.
Figure 6:
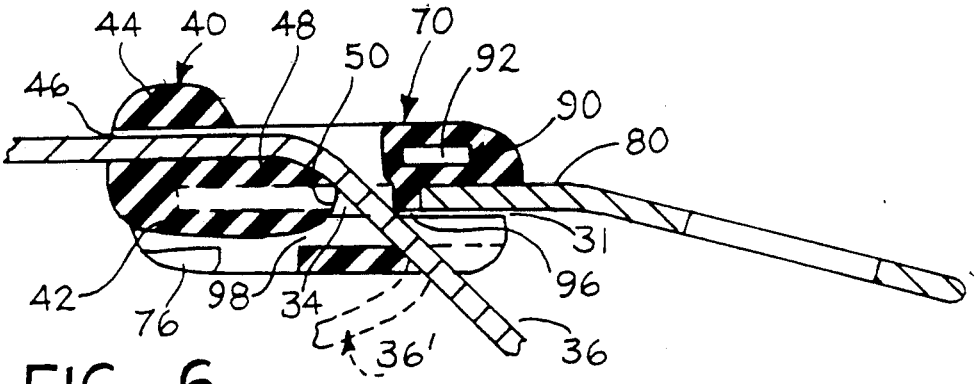
FIG. 6 shows seat belt webbing threaded through the latch plate assembly.

Secured to the plate 12 is a web guide 40 shown in the isolated view of the plate 12 in FIG. 2 as well as in FIGS. 3, 4 and 6. The web guide 40 is fabricated of a synthetic material such as Nylon 6/6 and is preferable insert molded about the rear cross bar 30. The web guide 40 includes a base member 42 (see FIGS. 3, 4 and 6) which envelopes a portion of the rear cross bar 30 and additionally includes an elevated member 44 which is spaced from the base member 42 as well as being spaced from the rear cross bar 30. The members 42 and 44 cooperate to define a web guide slot 46 which is positioned above a plane that contains the rear cross bar 30.

This web guide slot 46 is typically of oblong or rectangular shape and laterally extends relative to the tongue 14 to receive the seat belt webbing 36 and prevent same from twisting.

The elevated member 44 includes a sloped surface 48 which extends away from the first opening 34 and includes a first engagement surface 50 which extends laterally across the rear side of the first opening. As can be seen from the figures, the first engagement surface 50 extends into the first opening 34.

The cover 70 of the latch plate assembly 10 is slideably received about the plate 12, and comprises first and second side members 72*a* and 72*b*, a top crossmember 74 and a bottom crossmember 76 all of integral construction. Each of the first and second side members 72*a* and 72*b* include a respective axially extending slot 78*a* through which is received a corresponding side 32*a* or 32*b* of the plate 12. The top crossmember 74 joins the first and second side members 72*a*, 72*b* and is slideably received relative to a top surface 80 of the front cross bar 31. The top crossmember 74 includes a rib 82 which extends downward into the first opening 34 so as to engage a front side of the first opening 34 when the cover is slid forwardly on the plate 12 and also compressively loads the seat belt webbing 36 against the first engagement surface 50 when the cover 70 is moved rearwardly (see FIG. 6).

The top crossmember 74 includes a reinforcement means 90 the purpose of which is to stiffen the top crossmember. This reinforcement means 90 includes a bar 92 which is preferably insert molded within the top crossmember. This bar is visibly shown by dotted lines in FIG. 1 as well as in FIGS. 4 and 6.

The bottom crossmember 76 also joins the first and second side members 72*a* and 72*b* and is also spaced (see numeral 98) from the underside 94 of the plate 12. The bottom crossmember 76 is also spaced from the bottom 96 of the rib 82 so that the webbing 36 may extend through the first opening 34 and through this underside space 98 forward of the bottom crossmember 76.

The operation of the present invention is as follows: when the latch plate assembly 10 is unlatched from its cooperating buckle, a retractor (not shown) will retract the webbing which in turn will urge the latch plate assembly 10 upwardly typically towards a D-ring (not shown) of known variety typically attached to the B-column of the vehicle. During this condition, the orientation of the seat belt webbing 36 relative to the latch plate assembly 10 is generally as shown in FIG. 6. In this condition the webbing lightly engages the web guide 40 as well as the rib 82. A sufficient frictional force will be generated therebetween such that as the seat belt webbing 36 is retracted the latch plate assembly 10 will be carried with the webbing up to the D-ring. When the latch plate assembly 10 contacts the D-ring, the webbing will continue to be retracted under the rewind operation of the retractor with the latch plate assembly 10 remaining in contact with the D-ring. One advantage of the present invention is that upon retraction of the seat belt webbing the latch plate assembly 10 will be positioned proximate the D-ring at a defined, stored position providing easy access to the occupant.

When the operator desires to attach the latch plate assembly 10 to the buckle the latch plate is pulled from the above described stored position toward the buckle. In this condition the webbing 36' (see FIG. 6) is somewhat bent or folded about the latch plate assembly as shown by the phantom lines in this figure. Subsequently, the latch plate assembly 10 is fitted to its buckle. With the webbing in a position such as that shown by the phantom lines of FIG. 6, the webbing engages the bottom crossmember 76 thereby urging the cover 70 rearwardly. As the cover 70 moves rearwardly the rib 82 compressively loads the seat belt 36' against the first engagement surface 50 to provide the cinching function.

Many changes and modifications in the above described embodiment of the invention can, of course, be carried out without departing from the scope thereof. Accordingly, that scope is intended to be limited only by the scope of the appended claims.

We claim:

1. A latch plate assembly (10) comprising:

a plate (12) having a tongue (14) formed at one end (16) thereof, and a back portion (18) opposite the tongue (14);

the tongue (14) including means for receiving (20) a locking mechanism of a cooperating buckle, such receiving means (20) including at least one aperture (22) formed in the tongue (14);

the back portion (18) including a front cross bar (31) and a rear cross bar (30), sides (32*a*, 32*b*) joining the front cross bar (31) with the rear cross bar (30) and a first opening (34) of sufficient size to receive seat belt webbing (36);

a web guide (40), insert molded about the rear cross bar (30) and including an elevated member (44) spaced from a base member (42) and, spaced from the rear cross bar (30), the base and elevated members (42, 44) cooperating to define a web guide slot (46), positioned above a plane containing the rear cross bar (30) and laterally extending to receive the seat belt webbing (36);

the elevated member (44), including a sloped surface (48) extending away from the first opening (34) and a first engagement surface (50) extending laterally across the rear cross bar (30) at the rear of the first opening (34);

a cover (70), slidingly received about plate (12), comprising:

first and second side members (72*a*, 72*b*), a top crossmember (74) and a bottom crossmember (76), each of the first and second side members (72*a*, 72*b*) including a slot (78*a*, 78*b*) through which is received a corresponding side (32*a*, 32*b*) of the plate (12);

the top crossmember (74) joining the first and second side members (72*a*, 72*b*) and slidably received relative to a top surface (80) of the front cross bar (31); the top crossmember (74) includes a rib (82) extending into the first opening (34) so as to engage a front side of the first opening (34) when the cover (76) is slid forward on the plate (12) and to compressively load the seat belt webbing (36) against the first engagement surface (50) when the cover (70) is moved rearwardly, the top crossmember (74) including reinforcement means (90) for stiffening same, such reinforcement means (90) including a bar (92) within the top crossmember (74);

the bottom crossmember (76), joins the first and second side members (72*a*, 72*b*) and is spaced (98) from the underside (94) of the plate (12) and the bottom (96) of the rib (82) such that the webbing (36) may extend through the first opening (34) and extend through the underside space (98) forward of the bottom crossmember (76) to exert a rearward pressure thereon.

2. A latch plate assembly (10) comprising:

a plate (12) having a tongue (14) formed at one end (16) thereof, a back portion (18) opposite the tongue (14) the back portion (18) including a front cross bar (31) and a rear cross bar (30), sides 32*a*, 32*b*) joining the front cross bar (31) with the rear cross bar (30), and a first opening formed in the back portion.(18);

a web guide (40), is positioned about the back portion (18) and includes an elevated member (44) spaced above the back portion (18) and a lower member (42) positioned below the back portion (18), the lower and elevated members (42, 44) cooperating to define a web guide slot (46) laterally extending to receive the seat belt webbing (36);

the elevated member (44), including a sloped surface (48) extending away from the first opening (34) and a first engagement surface (50) extending laterally across a rear side of the first opening (34); the latch plate assembly further includes:

a cover (70) slidingly received about the plate (12) relative to the web guide (40) comprising:

first and second side members (72*a*, 72*b*), a top crossmember (74) and a bottom crossmember (76), each of the first and second side members (72*a*, 72*b*) including a slot (72*a*, 78*b*) through which is received a corresponding side of said plate (32*a*, 32*b*); the top crossmember (74) includes a rib (82) extending into the first opening (34) so as to engage a front side of the first opening (34) when the cover (70) is slid forward on the plate (12) and to compressively load the seat belt webbing (36) against the first engagement surface (50) when the cover (70) is moved rearwardly.

3. The assembly as defined in claim 2 wherein the top crossmember (74) including reinforcement means (90) for stiffening same such reinforcement means (90) including a bar (92) within the top crossmember (74).

4. The assembly as defined in claim 3 wherein the reinforcement bar (92) is insert molded into the top crossmember (74).

5. The assembly as defined in claim 4 wherein the web guide slot (46) is positioned above a plane containing the rear cross bar (30).

6. The assembly as defined in claim 5 wherein the bottom crossmember (76) is spaced (98) from the underside (94) of the plate (12) and a bottom (96) of the rib (82) such that the webbing (36) may extend through the first opening (34) through the underside space (98), forward of the bottom crossmember (76), so that when the webbing is bent rearwardly the webbing exerts a rearward pressure thereon causing the cover (70) to slide toward the web guide (40).

7. The assembly as defined in claim 2 wherein the web guide slot (46) is slightly larger than the webbing to prevent same from twisting.

* * * * *